US010189597B2

(12) United States Patent
Strasser et al.

(10) Patent No.: US 10,189,597 B2
(45) Date of Patent: Jan. 29, 2019

(54) FOOTED CONTAINER BASE

(71) Applicant: AMCOR RIGID PLASTICS USA, LLC, Wilmington, DE (US)

(72) Inventors: Walter J. Strasser, Cement City, MI (US); Mark Woloszyk, Chelsea, MI (US); Guizhang Zheng, Fort Wayne, IN (US); Theodore F. Eberle, Ann Arbor, MI (US); Pankaj Kumar, Dexter, MI (US); Nitin Gulati, Canton, MI (US)

(73) Assignee: Amcor Rigid Plastics USA, LLC, Wilmington, DE (US)

( * ) Notice: Subject to any disclaimer, the term of this patent is extended or adjusted under 35 U.S.C. 154(b) by 52 days.

(21) Appl. No.: 15/101,448

(22) PCT Filed: Dec. 3, 2013

(86) PCT No.: PCT/US2013/072783
§ 371 (c)(1),
(2) Date: Jun. 3, 2016

(87) PCT Pub. No.: WO2015/084324
PCT Pub. Date: Jun. 11, 2015

(65) Prior Publication Data

US 2016/0297558 A1 Oct. 13, 2016

(51) Int. Cl.
*B65D 1/02* (2006.01)

(52) U.S. Cl.
CPC ..... *B65D 1/0284* (2013.01)

(58) Field of Classification Search
CPC .... B65D 1/0284; B65D 79/005; B29C 49/06; B29C 49/48; B29B 2911/1402;
(Continued)

(56) References Cited

U.S. PATENT DOCUMENTS 5,913,438 A 6/1999 Beck et al.
2007/0158299 A1 7/2007 Young et al.
(Continued)

FOREIGN PATENT DOCUMENTS

WO WO-2009099864 A2 8/2009

OTHER PUBLICATIONS

International Search Report and Written Opinion for PCT/US2013/072783, dated Sep. 1, 2014; ISA/KR.
(Continued)

*Primary Examiner* — J. Gregory Pickett
*Assistant Examiner* — Elizabeth Volz
(74) *Attorney, Agent, or Firm* — Harness, Dickey & Pierce, P.L.C.

(57) ABSTRACT

A one-piece plastic container including a base portion. A gate area is at an axial center of the base portion. A plurality of feet are radially spaced apart about the axial center. Each strap of a plurality of straps is arranged between neighboring feet. Each one of a plurality of fillet areas is arranged between one of the plurality of feet and straps on opposite sides thereof. A cumulative strap surface area is defined by a total surface area of the plurality of straps, the gate area, and half a total surface area of the plurality of fillet areas. A cumulative foot surface area defined by a total surface area of the plurality of feet and half the total surface area of the plurality of fillet areas. The base portion has a ratio of cumulative foot surface area to cumulative strap surface area in the range of 2.4-2.8:1.

16 Claims, 6 Drawing Sheets

(58) Field of Classification Search
CPC . B29B 2911/14026; B29B 2911/14033; B29B 2911/1404; B29B 2911/14053; B29B 2911/14066; B29B 2911/1408; B29B 2911/14093; B29B 2911/14106; B29B 2911/14113; B29B 2911/14133; B29B 2911/1414
USPC ..... 215/370, 371, 373, 375, 377; 220/606, 220/608
See application file for complete search history.

(56) References Cited

U.S. PATENT DOCUMENTS

2008/0302758 A1* 12/2008 Mody ..... B29C 49/48 215/375
2010/0326950 A1 12/2010 Lane

OTHER PUBLICATIONS

European Search Report dated Jun. 1, 2017 in corresponding European Patent Application No. 138985049 (5 pages).

* cited by examiner

| | Foot Angle | Strap Angle | Hemispherical Surface Area (cm 2) | Total Base Surface Area (cm 2) | Foot Surface Area (cm 2) | Strap Surface Area (cm 2) | Gate Surface Area (cm 2) | Fillet Surface Area (cm 2) | Pad Surface Area (cm 2) | Pad Width (mm) | Pad Length (mm) |
|---|---|---|---|---|---|---|---|---|---|---|---|
| Example 1 | 36.75° | 35.84° | 15.273 | 194.646 | 115.497 | 28.611 | 1.725 | 48.813 | 1.958 | 7.26 | 7.18 |
| Example 2 | 33.9° | 39.75° | 5.044 | 83.648 | 46.081 | 7.502 | 1.244 | 28.821 | 1.537 | 6.26 | 6.68 |
| Example 3 | 33.1° | 32.9° | 6.021 | 78.25 | 43.535 | 6.585 | 1.188 | 26.924 | 1.467 | 6.11 | 6.53 |
| Example 4 | 28.6° | 28.1° | 3.963 | 60.025 | 33.379 | 5.255 | 0.517 | 20.874 | 0.952 | 5.02 | 5.1 |

| Foot Width (mm) | Strap Radius | Foot Radius | Foot Length (mm) | Cumulative Strap Surface Area (cm 2) | Cumulative Foot Surface Area (cm 2) | Foot To Strap Ratio | Pad Surface Area as % of Total Base Surface Area | Pad Surface Area as % of Total Foot Surface Area | Foot Radius as % of Foot Width |
|---|---|---|---|---|---|---|---|---|---|
| 23.518 | 63.64° | 11.98° | 44.09 | 54.7425 | 139.9035 | 2.6 : 1 | 1.01% | 1.40% | 50.94% |
| 16.83 | 32.5° | 8.695° | 30.45 | 23.1565 | 60.4915 | 2.6 : 1 | 1.84% | 2.54% | 51.66% |
| 16.44 | 32.21° | 8.39° | 29.75 | 21.235 | 56.997 | 2.7 : 1 | 1.87% | 2.57% | 51.03% |
| 13.515 | 29.29° | 6.61° | 25.57 | 16.209 | 43.816 | 2.7 : 1 | 1.59% | 2.17% | 48.91% |

FIG - 11

FOOTED CONTAINER BASE

CROSS REFERENCE TO RELATED APPLICATION

This application is a U.S. National Phase Application under 35 U.S.C. 371 of International Application No. PCT/US2013/072783 filed on Dec. 3, 2013 and published as WO 2015/084324 A1 on Jun. 11, 2015, the entire disclosure of which is incorporated herein by reference.

FIELD

The present disclosure relates to a footed container base.

BACKGROUND

This section provides background information related to the present disclosure, which is not necessarily prior art.

As a result of environmental and other concerns, plastic containers, more specifically polyester and even more specifically polyethylene terephthalate (PET) containers, are being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Typically, an upper portion of the plastic container defines an opening. This upper portion is commonly referred to as a finish and includes some means for engaging a cap or closure to close off the opening. In the traditional injection-stretch blow molding process, the finish remains substantially in its injection molded state while the container body is formed below the finish. The finish may include at least one thread extending radially outwardly around an annular sidewall defining a thread profile. In one application, a closure member or cap may define a complementary thread, or threads, that are adapted to cooperatively mate with the threads of the finish.

In some applications, plastic containers must withstand extreme pressures, such as when containing carbonated beverages. One common design includes providing plastic containers having multiple feet-like structures formed around the base. A typical base consists of five such feet and is commonly referred to as a petaloid base. An exemplary container including a petaloid base is described in U.S. Pat. No. 7,891,513 ("'513 patent") titled "Container Base with Feet," which issued on Feb. 22, 2011 and is assigned to Amcor Limited. The disclosure of U.S. Pat. No. 7,891,513 is incorporated herein by reference. Additional exemplary containers are described in the following patents, the disclosures of which are also incorporated herein by reference: U.S. Pat. No. 5,484,072 titled "Self-Standing Polyester Containers for Carbonated Beverages," which issued on Jan. 16, 1996 and is assigned to Amcor Limited; and U.S. Pat. No. 5,529,196 titled "Carbonated Beverage Container With Footed Base Structure," which issued on Jun. 25, 1996 and is assigned to Amcor Limited.

In some instances, conventional petaloid base designs do not have the desired performance characteristics to withstand the extreme pressures of carbonated beverages, particularly when manufactured at high speeds (i.e., greater than 1,600 containers per hour for each mold cavity). For example, some petaloid base designs experience creasing at the feet thereof caused by carbonation pressure within the container after it has been filled. Under normal conditions, a filled and capped container can experience an internal carbonation pressure in excess of 75 PSI (5 bar). Creasing can become more pronounced as customers require lighter weight containers. Prior art FIG. 10 illustrates a container 210 including feet 212 that have undesirable creasing 214.

There is thus a need for a plastic container design that has a base capable of withstanding extreme internal pressure, and exhibits significant increased resistance to breakage and creasing at the feet subsequent to filling. Furthermore, there is a need to provide a container base providing increased stability to the container when empty as well as subsequent to filling. As described herein, the teachings of this present application address these needs by, for example, providing a container base with a smooth, balanced, and stable base geometry that is able to distribute internal pressure to reduce stress in the feet of the container base.

SUMMARY

This section provides a general summary of the disclosure, and is not a comprehensive disclosure of its full scope or all of its features.

The present teachings provide for a plastic container including an upper portion, a cylindrical sidewall, and a base portion. The upper portion defines an opening at an upper end of the container. The cylindrical sidewall extends from the upper portion and defines a storage volume accessible through the opening. The base portion extends from the cylindrical sidewall to a base end of the container that is opposite to the upper end of the container. The base portion includes a gate area at an axial center of the base portion, a plurality of feet radially spaced apart about the axial center, a plurality of straps, and a plurality of fillet areas. Each one of the plurality of straps are arranged between neighboring ones of the plurality of feet, and the plurality of fillet areas. Each one of the plurality of fillet areas are arranged between one of the plurality of feet and straps on opposite sides thereof. The base portion further includes a cumulative strap surface area and a cumulative foot surface area. The cumulative strap surface area is defined by a total surface area of the plurality of straps, the gate area, and half a total surface area of the plurality of fillet areas. The cumulative foot surface area is defined by a total surface area of the plurality of feet and half the total surface area of the plurality of fillet areas. The base portion has a ratio of cumulative foot surface area to cumulative strap surface area in the range of 2.4-2.8:1.

The present teachings further provide for a one-piece plastic container including an upper portion, a cylindrical sidewall, and a base portion. The upper portion defines an opening at an upper end of the container. The cylindrical sidewall extends from the upper portion and defines a storage volume accessible through the opening. The base portion extends from the cylindrical sidewall to a base end of the container that is opposite to the upper end of the container. The base portion includes a plurality of feet radially spaced apart about an axial center of the base portion. Each one of the plurality of feet includes an outer foot surface at an outer diameter of the base portion that tapers inward at a first angle along a length thereof extending towards the base end of the container. A plurality of straps are arranged between neighboring ones of the plurality of feet. Each one of the plurality of straps taper inward along a length thereof extending towards the axial center of the base portion. A plurality of fillet areas each include a first fillet portion extending along a first side of each one of the plurality of straps, and a second fillet portion extending along a second side of each one of the plurality of straps. The first and the second fillet portions are arranged to taper towards one another at a second angle along respective lengths thereof extending towards the axial center of the base portion. The first angle is generally similar to the second angle.

The present teachings also provide for a one-piece plastic container. The container includes an upper portion defining an opening at an upper end of the container. A cylindrical sidewall extends from the upper portion and defining a storage volume accessible through the opening. A base portion extends from the cylindrical sidewall to a base end of the container that is opposite to the upper end of the container. A plurality of feet are included with the base portion. The plurality of feet are radially spaced apart about the axial center of the base portion and each includes a circular contact pad configured to support the container upright on a support surface. Each contact pad has a pad length extending radially away from a longitudinal axis of the container and a pad width extending generally perpendicular to the pad length. A plurality of straps are arranged between neighboring ones of the plurality of feet.

The present teachings still further provide for a one-piece plastic container including an upper portion defining an opening at an upper end of the container. A cylindrical sidewall extends from the upper portion and defines a storage volume accessible through the opening. A base portion extends from the cylindrical sidewall to a base end of the container that is opposite to the upper end of the container. A plurality of feet are included with the base portion. The feet are radially spaced apart about the axial center of the base portion. Each one of the plurality of feet has a foot length extending radially away from a longitudinal axis of the container. A foot width extends generally perpendicular to the foot length. A foot radius extends along at least a portion of the foot width. The foot width is about twice as large as the root radius. A plurality of straps are arranged between neighboring ones of the plurality of feet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 11 is a chart listing dimensions of exemplary one-piece plastic containers according to the present teachings.

Corresponding reference numerals indicate corresponding parts throughout the several views of the drawings.

DETAILED DESCRIPTION

Example embodiments will now be described more fully with reference to the accompanying drawings.

Figure 1:
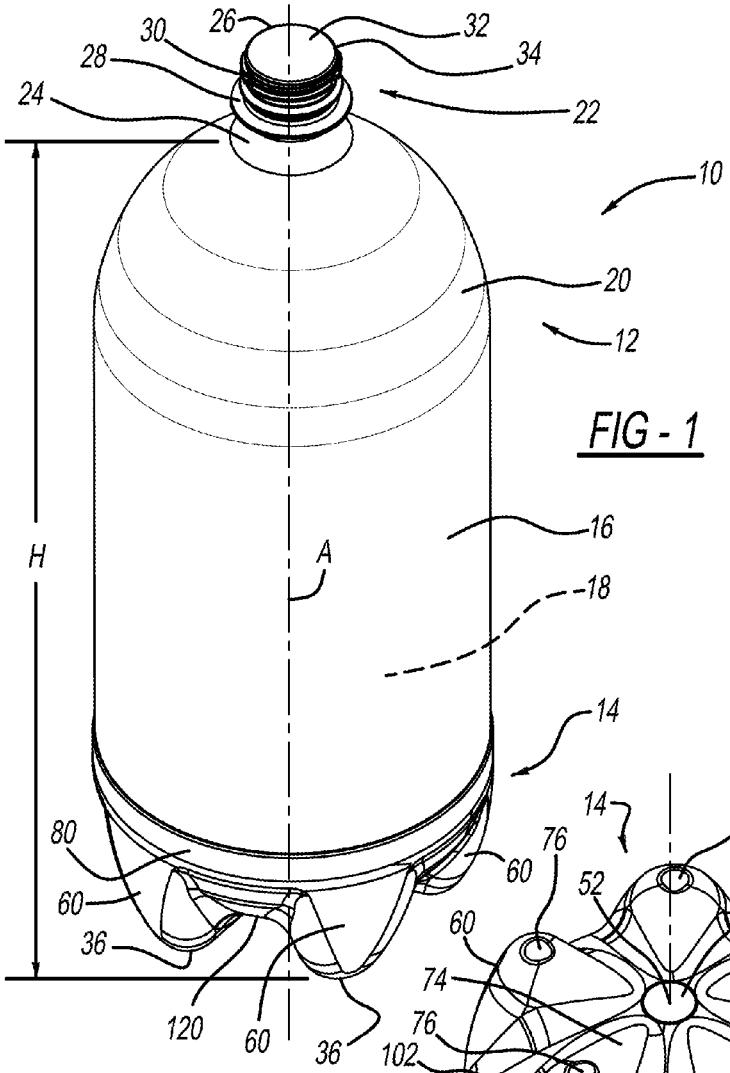
FIG. 1 is a side elevational view of a one-piece plastic container according to the present teachings.
Figure 2:
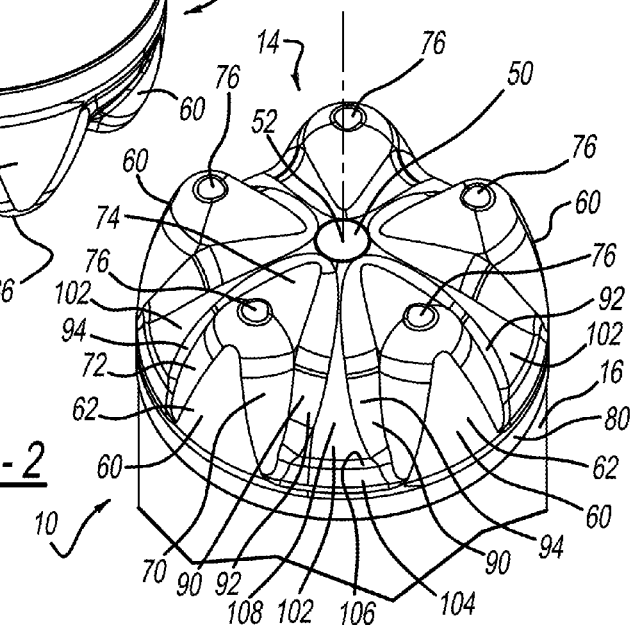
FIG. 2 is a bottom perspective view of a base portion of the container of FIG. 1.

With initial reference to FIG. 1, an exemplary container according to the present teachings is generally illustrated at reference numeral 10. The container 10 can be any suitable container of any appropriate size, and made of any suitable thermoplastic material. As illustrated, the container 10 has a volume capacity of about two liters (2,000 cc). The present teachings are generally applicable to any other suitable container as well, such as a rectangular, triangular, hexagonal, octagonal, or square-shaped container, which may have different dimensions and/or volume capacities, such as 12 oz, 24 oz, 500 ml, 32 oz, 64 oz, 128 oz, or 1 liter.

The container 10 is an injection-stretch blow molded, biaxially oriented container having a unitary construction from a single or multi-layer material. A well-known stretch-molding process for making the container 10 is generally set forth in the '513 patent (the disclosure of which is incorporated herein by reference as set forth above), and includes manufacture of a preform or a polyester material, such as polyethylene terephthalate (PET), having a shape similar to a test-tube with a generally cylindrical cross-section and a length typically about 50% that of a resultant height H of the container 10. As illustrated in FIG. 1, the container 10 has an overall height H of about 266.45 mm (10.49 inches), excluding a finish 22 of the container 10. The container 10 can define a longitudinal axis A and be substantially cylindrical in cross-section. The container 10 is configured to retain any suitable commodity therein, such as a solid or liquid commodity.

The container 10 generally includes an upper portion 12 and a base portion 14. Extending between the upper portion 12 and the base portion 14 is a cylindrical sidewall 16, which defines a storage volume 18. Extending from an upper portion of the sidewall 16 is a shoulder region 20 of the upper portion 12. The shoulder region 20 extends towards a finish 22 of the upper portion 12, and gradually curves or tapers inward as it extends towards the finish 22. A neck 24 of the upper portion 12 connects the finish 22 to the shoulder region 20.

The finish 22 includes an annular sidewall 26. Extending from an outer edge of the annular sidewall 26 proximate to the neck 24 is an annular rib 28. Threads 30 also extend from an outer surface of the annular sidewall 26, on a side of the annular rib 28 opposite to the neck 24. The threads 30 can be configured in any suitable manner to permit cooperation with threads of a suitable closure or cap, in order to couple the closure or cap to the finish 22 and cover or close an opening 32 defined by the annular sidewall 26. The opening 32 provides access to the storage volume 18, and is at an upper end 34 of the container 10.

The upper end 34 is at an end of the container 10 opposite to a base end 36 of the base portion 14. Longitudinal axis A of the container 10 extends through a radial center of the opening 32 and along a length of the container 10 generally at a center of the container 10. The height H of the container 10 generally extends from the base end 36 to an interface between the shoulder region 20 and the finish 22.

With continued reference to FIG. 1 and additional reference to FIGS. 2-9, the base portion 14 will now be described in detail. The base portion 14 generally includes a gate area 50 at an axial center 52 of the base portion 14 through which the longitudinal axis A of the container 10 extends. Radially arranged about the gate area 50 and the axial center 52 are a plurality of feet 60. The feet 60 are radially spaced apart about the base portion 14. Any suitable number of feet 60 can be provided, such as five feet 60 as illustrated, thus generally providing the base portion 14 as a pentaloid base.

Figure 3:
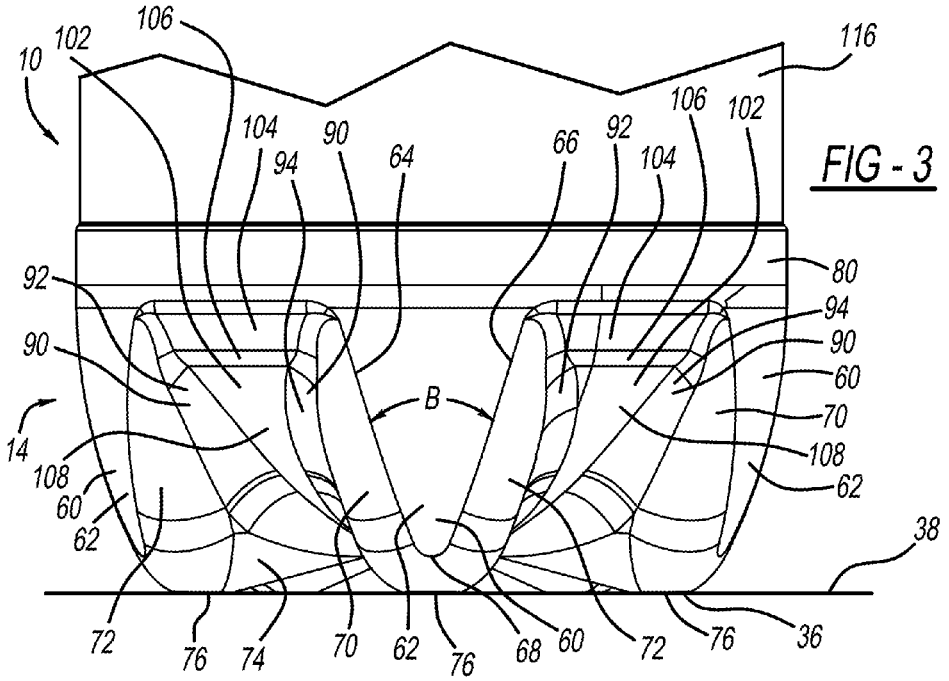
FIG. 3 is a side view of the base portion of the container of FIG. 1.

Each foot 60 generally includes an outer foot surface 62. Each of the outer foot surfaces 62 generally extend from about an outer surface 80 of the base portion 14 at an outer diameter thereof towards the base end 36. With reference to FIG. 3 for example, each outer foot surface 62 includes a first edge 64 and a second edge 66, and is generally curved between the first and second edges 64 and 66. The first and second edges 64 and 66 are angled such that they are spaced apart at an upper end of the outer foot surface 62, proximate to the outer surface 80 for example, and converge generally at a distal end 68 of the outer foot surface 62. The first edge 64 and the second edge 66 are angled at an angle B relative to one another, as illustrated in FIG. 3 for example. The angle B can be any suitable angle, such as 36°, about 36°, 36.75°, about 36.75°, or within about 5.0° of 36° or 36.75°.

Each foot 60 includes a first side surface 70 adjacent to the first edge 64 and a second side surface 72 adjacent to the second edge 66. The first and second side surfaces 70 and 72 are generally angled and sloped such that they converge generally between the distal end 68 of the outer foot surface 62 and a bottom surface 74 of the feet 60. The bottom surface 74 generally mates with the first and second side surfaces 70 and 72 at the base end 36. From the first and second side surfaces 70 and 72, the bottom surfaces 74 extend towards the gate area 50 and generally taper away from the base end 36.

The base portion 14 further includes a plurality of contact pads 76 at the base end 36. The contact pads 76 are generally configured to support the container 10 upright on a support surface 38, such as a table or any planar surface. Each one of the feet 60 includes one of the contact pads 76 as illustrated, however, each foot 60 can be provided with any suitable number of contact pads 76. Each one of the contact pads 76 is generally located at the interface between the first and second side surfaces 70 and 72 and the bottom surface 74 of the feet 60. The contact pads 76 can be arranged in an overall circular pattern along contact diameter Dc, which extends about the base end 36. Each one of the contact pads 76 is generally round or circular as illustrated, and thus not rectangular. However, the contact pads 76 can have any suitable shape configured to adequately support the container 10 upright on the support surface 38.

Figure 6:
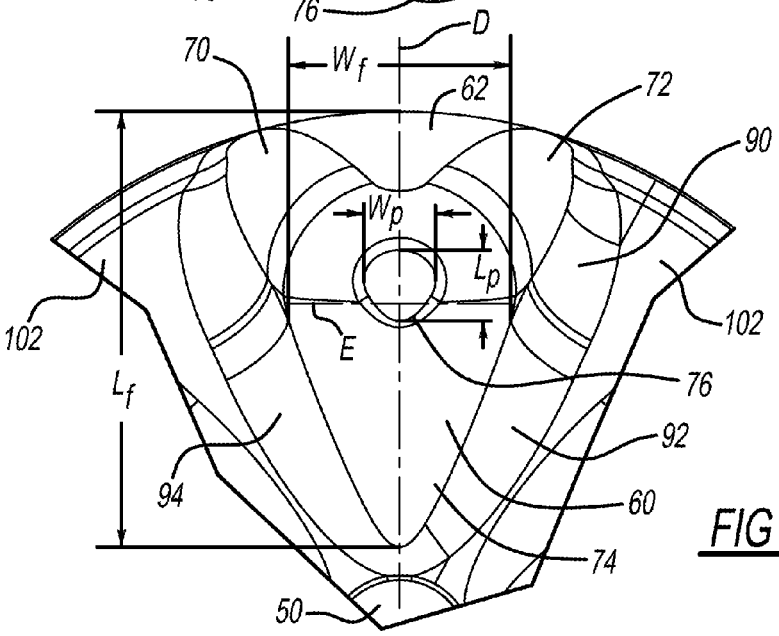
FIG. 6 is a bottom plan view of a foot of the base portion of the container of FIG. 1.

With reference to FIG. 6 for example, each one of the contact pads 76 includes a length $L_p$ and a width $W_p$. The length $L_p$ is generally measured along a line D extending radially from the axial center 52 of the base portion 14 through a general center of the pads 76. The width $W_p$ is generally measured transverse to the line D at a widest portion of the pads 76. Each one of the pads 76 can include any suitable length $L_p$ and any suitable width $W_p$. For example, the length $L_p$ and the width $W_p$ can be generally the same or exactly the same. For example, the length $L_p$ can be 7.18 mm, about 7.18 mm, or within 3 mm of 7.18 mm. The width $W_p$ can be 7.26 mm, about 7.26 mm, or within about 3 mm of 7.26 mm.

The contact pads 76 can have any suitable surface area. For example, a total surface area of all of the plurality of contact pads 76 can be 1% about 1%, or within the range of 0.5%-1.5% of a total surface area of the base portion 14. A total surface area of the contact pads 76 can be 1.4%, about 1.4%, or within the range of 0.9%-1.9% of a cumulative foot surface area of the feet 60, which as defined herein can be a total surface area of all of the feet 60 and half of a total surface area of all fillet areas 90. When the base portion 14 includes five contact pads 76, the total surface area of the five contact pads 76 can be 1.958 $cm^2$, about 1.958 $cm^2$, or within about 0.5 $cm^2$ of 1.958 $cm^2$.

Each foot 60 generally includes, with reference to FIG. 6 for example, a length $L_f$ and a width $W_f$. The length $L_f$ is generally measured between a portion of the bottom surface 74 closest to the gate area 50 and a portion of the outer foot surface 62 that is furthest from the gate area 50. Typically, the line D radially extending from the axial center 52 of the base portion 14 extends along the length $L_f$. The width $W_f$ is measured along a line E, which extends generally perpendicular to the line D and intersects with line D at the contact pads 76. At least a portion of the line E extends along the interface between the first and second side surfaces 70 and 72 and the bottom surface 74 of the foot 60, particularly proximate to the contact pads 76. The foot width $W_f$ can be any suitable width, such as 23.518 mm, about 23.518 mm, or within about 5.0 mm of 23.518 mm. Each foot 60 can have any suitable length $L_f$, such as 44 mm, about 44 mm, or within about 5.0 mm of 44 mm.

Figure 7:
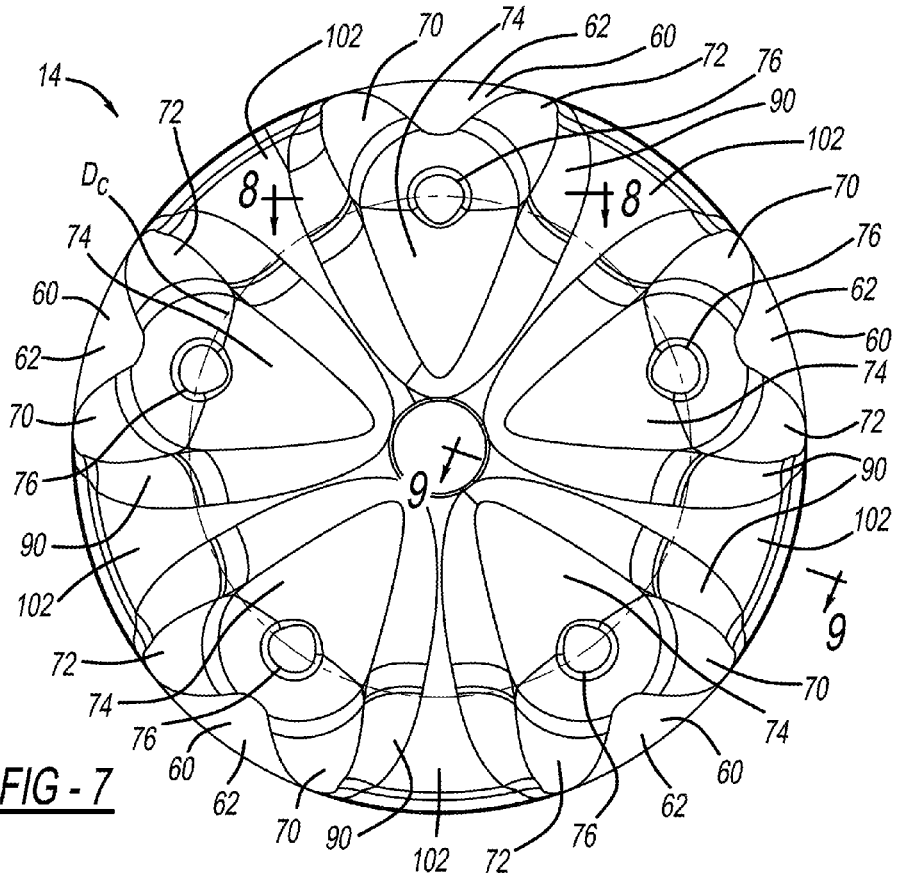
FIG. 7 is a bottom plan view of the base portion of the container of FIG. 1.
Figure 8:
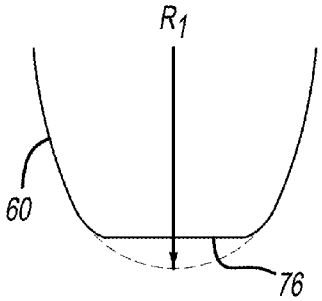
FIG. 8 is a cross-sectional view taken along line 8-8 of FIG. 7.

With additional reference to FIGS. 7 and 8, each foot 60 can have a foot radius $R_1$, as measured at line 8-8 of FIG. 7. The foot radius $R_1$ is generally measured from where the feet 60 protrude from the base portion 14. At a lower-most or distal-most portion of the feet 60, the foot radius $R_1$ is measured to where the feet 60 extended prior to formation of the flat contact pads 76, represented by the phantom line of FIG. 8. The foot radius $R_1$ can be any suitable dimension, such as 11.98 mm, about 11.98 mm, or within about 3.0 mm of 11.98 mm. In order to help distribute internal pressures experienced by the base portion 14 proximate to and at the contact pads 76, the foot width $W_f$ can be about twice the size of the foot radius $R_1$. In other words, the foot radius $R_1$ can be about 50% smaller than the foot width $W_f$.

The base portion 14 further includes a plurality of fillet areas 90. Each one of the fillet areas 90 extends about a different one of the feet 60. For example, each fillet area 90 includes a first fillet portion 92 and a second fillet portion 94. The first and second fillet portions 92 and 94 extend along opposite sides of the feet 60 and converge proximate to the gate area 50. The fillet areas 90 are generally concave recesses defined within the base portion 14.

Figure 4:
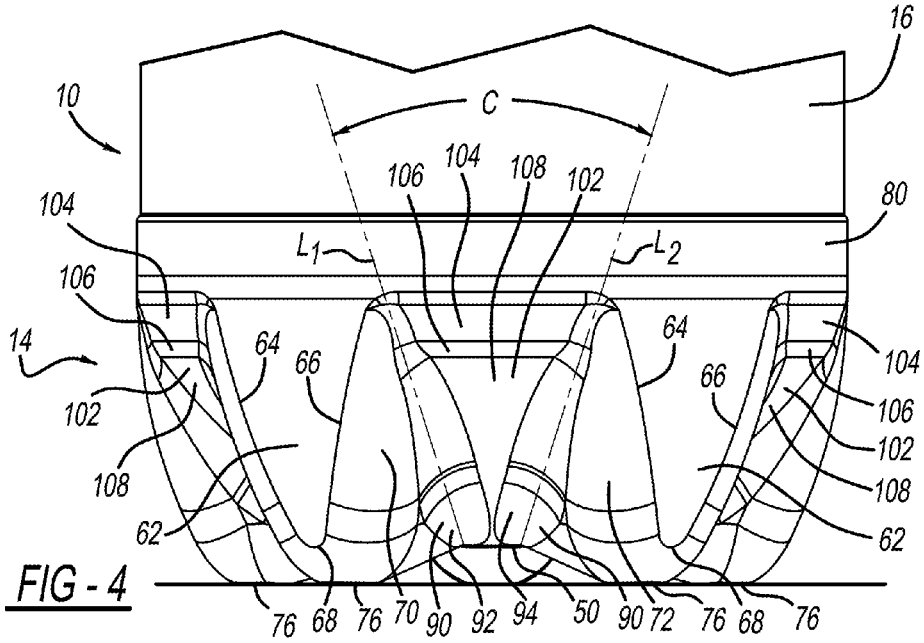
FIG. 4 is another side view of the base portion of the container of FIG. 1.
Figure 5:
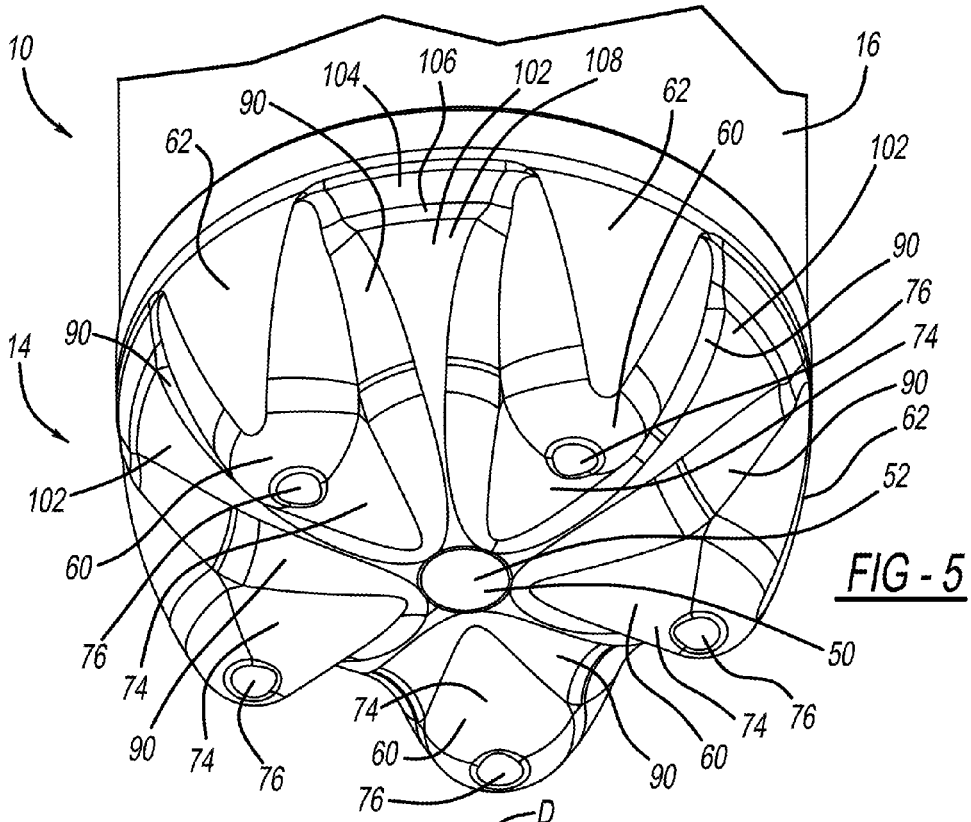
FIG. 5 is a perspective view of the base portion of the container of FIG. 1.

With reference to FIG. 4 for example, a first longitudinal axis $L_1$ of the first fillet portion 92 extends across a length of the first fillet portion 92 at generally a center thereof, and includes a second longitudinal axis $L_2$ of the second fillet portion 94 extending along a length thereof at generally a center of the second fillet portion 94. The first and second fillet portions 92 and 94 are generally angled along their lengths relative to one another such that angle C measured between the first longitudinal axis $L_1$ and the second longitudinal axis $L_2$ is 35.84°, about 35.84°, or within about 5.0° of 35.84°. The angle C can generally be the same as, or similar to, the angle B of the outer foot surfaces 62. For example, both the angle B and the angle C can be 36°, about 36° or within 5° of 36°. The angle B and the angle C can also differ from one another, such as within a range of 10°, or about 10° of one another.

The base portion 14 further includes a plurality of straps 102. Each one of the straps 102 is located between neighboring feet 60, and particularly between neighboring fillet areas 90. Each strap 102 generally includes an outermost portion 104, an intermediate portion 106, and a hemispherical portion 108. The outermost portion 104 is proximate to, or adjacent to, the outer surface 80, which is generally at the outermost diameter of the base portion 14. The intermediate portion 106 is between the hemispherical portion 108 and the outermost portion 104.

The hemispherical portion 108 continuously extends from the intermediate portion 106 to the gate area 50. The hemispherical portion 108 is generally smooth and tapers inward along a length thereof from the intermediate portion 106 to the gate area 50. The hemispherical portion 108 is most narrow proximate to, but spaced apart from, the gate area 50. The hemispherical portion 108 advantageously increases the overall strength of the base portion 14 so as to enhance the ability of the base portion 14 to resist internal pressures exerted upon the base portion 14, which may result in creasing at the feet 60.

Figure 9:
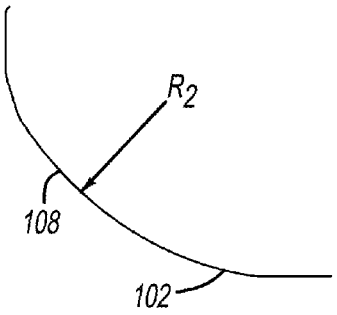
FIG. 9 is a cross-sectional view taken along line 9-9 of FIG. 7.
Figure 10:
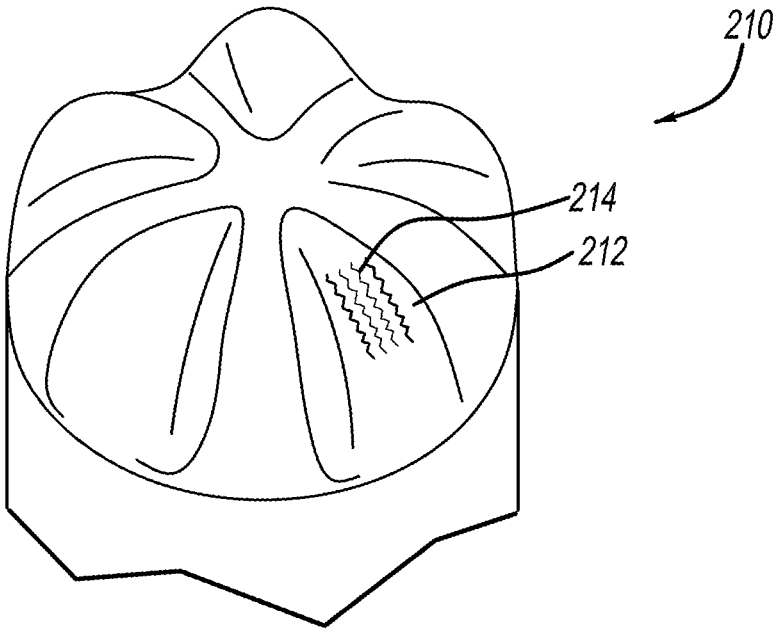
FIG - 10 Prior Art
FIG. 10 is a perspective view of a base portion of a prior art container with creasing at a foot thereof.

The hemispherical portions 108 can have any suitable surface area. For example, the hemispherical portions 108 can have a total surface area that is 9%, about 9%, within about 2% of 9%, 8.7%, about 8.7%, or within about 2% of 8.7% of a total surface area of the base portion 14. A ratio of a total surface area of the base portion 14 with respect to a total surface area of the hemispherical portions 108 can thus be 11.5:1, or about 11.5:1. For example, if the base portion 14 has a total surface area of 194.646 $cm^2$, the total surface area of all of the hemispherical portions 108 and the gate area 50 can be 16.998 $cm^2$, about 16.998 $cm^2$ or within 5.0 $cm^2$ of 16.998 $cm^2$. With reference to FIGS. 7 and 9, the hemispherical portions 108 can each have a radius $R_2$ of 63.5 mm, about 63.5 mm, or within about 5 mm of 63.5 mm. The container 10 can be provided with an overall radius of 54.4 mm, about 54.4 mm, or within 5 mm of 54.4 mm measured at a maximum diameter of the container 10]. Thus the radius $R_2$ of the hemispherical portion 108 is larger than the overall container radius. For example, each one of the plurality of straps 102 can have a hemispherical radius that is 1.1-1.3 times larger than an overall radius of the base portion, such as 1.17 times larger.

The feet 60, the fillet areas 90, and the straps 102 can each have any suitable area and dimensions in order to enhance the overall strength of the base portion 14, and decrease the possibility of creasing at the feet 60. For example, a cumulative foot surface area (including a total surface area of all of the feet 60 and half of a total surface area of all of the fillet areas 90) and a cumulative strap surface area (including a total surface area of all of the straps 102, a surface area of the gate area 50, and half of the total surface area of all of the fillet areas 90) can be provided at a ratio of 2.4-2.8:1, 2.6:1, or about 2.6:1. Of a total surface area of the base portion 14, 67%-77%, 72%, about 72%, or within 5% of 72% thereof can be the cumulative foot surface area, and 23%-33%, 28%, about 28%, or within 5% of 28% thereof can be the cumulative strap surface area. Thus a ratio of the total surface area of the base portion 14 with respect to the cumulative strap surface area can be 3.4-3.8:1, 3.6:1, or about 3.6:1. A ratio of the total surface area of the base portion 14 with respect to the cumulative foot surface area can be 1.2-1.6:1, 1.4:1, or about 1.4:1. For example, where the total surface area of the base portion 14 is 194.646 $cm^2$ or about 194.646 $cm^2$, the cumulative strap surface area can be 54.743 $cm^2$, about 54.743 $cm^2$ or within 10 $cm^2$ of 54.743 $cm^2$, and the cumulative foot surface area can be 139.904 $cm^2$, about 139.904 $cm^2$ or within 10 $cm^2$ 139.904 $cm^2$.

The fillet areas 90 can have a total fillet surface area of 48.813 $cm^2$, about 48.813 $cm^2$, or within 5 $cm^2$ of 48.813 $cm^2$. The gate area 50 can have a total surface area of 1.725 $cm^2$, about 1.725 $cm^2$, or within 0.5 $cm^2$ of 1.725 $cm^2$. The straps 102 (independent of the fillet areas 90) can have a total combined surface area of 28.611 $cm^2$, about 28.611 $cm^2$, or within 5 $cm^2$ of 28.611 $cm^2$. The feet 60 (independent of the fillet areas 90) can have a total combined surface area of 115.497 $cm^2$, about 115.497 $cm^2$, or within 10 $cm^2$ of 115.497 $cm^2$. FIG. 11 is a chart listing exemplary dimensions of four different one-piece plastic containers 10 according to the present teachings.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A one-piece plastic container comprising:

an upper portion defining an opening at an upper end of the container;

a cylindrical sidewall extending from the upper portion and defining a storage volume accessible through the opening; and a base portion extending from the cylindrical sidewall to a base end of the container that is opposite to the upper end of the container, the base portion including:

a gate area at an axial center of the base portion;

a plurality of feet radially spaced apart about the axial center;

a plurality of straps, each one of the plurality of straps arranged between neighboring ones of the plurality of feet; and a plurality of fillet areas, each one of the plurality of fillet areas arranged between one of the plurality of feet and straps on opposite sides thereof;

wherein the base portion includes a cumulative strap surface area defined by a total surface area of the plurality of straps, the gate area, and half a total surface area of the plurality of fillet areas, and a cumulative foot surface area defined by a total surface area of the plurality of feet and half the total surface area of the plurality of fillet areas;

wherein the base portion has a ratio of cumulative foot surface area to cumulative strap surface area in the range of 2.4-2.8:1;

wherein the base portion has a ratio of overall surface area to the cumulative strap surface area in the range of 3.4-3.8:1;

wherein the base portion has a ratio of overall surface area to the cumulative foot surface area of 1.2-1.6:1;

wherein about 67%-77% of an overall surface area of the base portion is the cumulative foot surface area; and wherein about 23%-33% of the overall surface area of the base portion is the cumulative strap surface area.

2. The one-piece plastic container of claim 1, wherein the base portion has about a 2.6:1 ratio of cumulative foot surface area to cumulative strap surface area.

3. The one-piece plastic container of claim 1, wherein the base portion has about a 3.6:1 ratio of overall surface area to the cumulative strap surface area.

4. The one-piece plastic container of claim 1, wherein the base portion has about a 1.4:1 ratio of overall surface area to the cumulative foot surface area.

5. The one-piece plastic container of claim 1, wherein about 72% of an overall surface area of the base portion is the cumulative foot surface area; and wherein about 28% of the overall surface area of the base portion is the cumulative strap surface area.

6. The one-piece plastic container of claim 1, wherein the base portion includes only five straps and only five feet; wherein each one of the plurality of straps extend continuously between the gate area and about an outer diameter of the base portion; and wherein each one of the plurality of straps includes a hemisphere portion that is generally smooth and curved along an entire length thereof.

7. The one-piece plastic container of claim 1, wherein the plurality of straps and the gate area have a combined surface area that is about 9% of an overall surface area of the base portion.

8. The one-piece plastic container of claim 1, wherein the plurality of straps and the gate area have a combined surface area that is about 8%-10% of an overall surface area of the base portion.

9. The one-piece plastic container of claim 1, wherein each one of the plurality of straps have a hemisphere radius that is about 1.17 times larger than an overall radius of the base portion.

10. The one-piece plastic container of claim 1, wherein each one of the plurality of straps have a hemisphere radius that is about 1.1-1.3 times larger than an overall radius of the base portion.

11. The one-piece plastic container of claim 1, wherein each one of the plurality of straps tapers inward along a length thereof proximate to the gate area.

12. The one-piece plastic container of claim 1, wherein each one of the plurality of feet include an outer foot surface at an outer diameter of the base portion that tapers inward at a first angle along a length thereof extending towards the base end of the container;

wherein each one of the fillet areas include a first fillet portion and a second fillet portion, the first fillet portion extending along a first side of each one of the plurality of straps and the second fillet portion extending along a second side of each one of the plurality of straps, the first and the second fillet portions arranged to taper towards one another at a second angle along respective lengths thereof extending towards the axial center of the base portion; and wherein the first angle is generally similar to the second angle.

13. The one-piece plastic container of claim 12, wherein the first angle and the second angle are both about 36°.

14. The one-piece plastic container of claim 12, wherein the first angle and the second angle are each within the range of 25° to 40°.

15. The one-piece plastic container of claim 12, wherein the first angle is within about 10° of the second angle.

16. The one-piece plastic container of claim 12, further comprising a plurality of contact pads configured to support the container upright on a support surface, each one of the plurality of feet including one of the plurality of contact pads, each one of the plurality of contact pads includes a pad length extending radially away from a longitudinal axis of the container and a pad width extending generally perpendicular to the pad length;

wherein the pad length is substantially similar to the pad width;

wherein the plurality of contact pads are in the range of 1% to 1.6% of a total surface area of the base portion, and are in the range of 1.4% to 2.2% of a total surface area of the plurality of feet;

wherein each one of the plurality of feet has a foot length extending radially away from a longitudinal axis of the container, a foot width extending generally perpendicular to the foot length, and a foot radius extending along at least a portion of the foot width; and wherein the foot width is about twice as large as the foot radius.

* * * * *